US010463138B1

(12) United States Patent
Boutin et al.

(10) Patent No.: US 10,463,138 B1
(45) Date of Patent: Nov. 5, 2019

(54) BACKPACK APPARATUS AND SYSTEM

(71) Applicants: Stephen Boutin, Louisville, KY (US); Bill Clark, Louisville, KY (US)

(72) Inventors: Stephen Boutin, Louisville, KY (US); Bill Clark, Louisville, KY (US)

( * ) Notice: Subject to any disclaimer, the term of this patent is extended or adjusted under 35 U.S.C. 154(b) by 0 days.

(21) Appl. No.: 15/932,349

(22) Filed: Feb. 20, 2018

Related U.S. Application Data

(60) Provisional application No. 62/459,899, filed on Feb. 16, 2017.

(51) Int. Cl.

| | |
|---|---|
| ***A45F 3/00*** | (2006.01) |
| ***A45F 3/12*** | (2006.01) |
| ***A45F 3/02*** | (2006.01) |
| ***A45F 3/04*** | (2006.01) |

(52) U.S. Cl.
CPC ..... *A45F 3/12* (2013.01); *A45F 3/02* (2013.01); *A45F 3/04* (2013.01); *A45F 2003/003* (2013.01); *A45F 2003/122* (2013.01); *A45F 2003/127* (2013.01); *A45F 2200/0566* (2013.01)

(58) Field of Classification Search
CPC ..... A45F 3/12; A45F 3/02; A45F 3/04; A45F 2003/003; A45F 3/122; A45F 3/127; A45F 2200/0566
USPC ..... 224/629
See application file for complete search history.

(56) References Cited

U.S. PATENT DOCUMENTS 3,679,108 A * 7/1972 Ingram ..... A45F 3/04 224/644
4,089,447 A 5/1978 Achmeteli
4,303,186 A * 12/1981 Ollinger, IV ..... A45F 3/08 224/634
D339,225 S * 9/1993 Zel ..... D3/217
5,361,955 A 11/1994 Gregory
5,503,314 A * 4/1996 Fiscus ..... A45F 3/08 224/262
5,553,759 A 9/1996 McMaster et al.
5,632,724 A 5/1997 Lerman et al.
(Continued)

FOREIGN PATENT DOCUMENTS

CN 204273586 U 4/2015
DE 102010038699 A1 2/2012
(Continued)

OTHER PUBLICATIONS www.goruck.com. Rucksacks. Retreived Feb. 16, 2018.
Chowdhry "How a Special Forces Soldier Built a Multimion-Dollar Backpack Brand" www.forbes.com. Feb. 12, 2018.

*Primary Examiner* — Peter N Helvey
(74) *Attorney, Agent, or Firm* — Middleton Reutlinger

(57) ABSTRACT

A backpack designed to reduce forward head posture is disclosed herein. Such a backpack may include: one or more shoulder straps, where each of the shoulder straps includes a sternal pad in contact with a wearer's sternum and upper anterior ribs when worn; a wedge-shaped sacral pad spanning a bottom of the backpack, the upper edge of which contacting a user's thoracolumbar junction when worn; one or more dorsal pads in contact with a wearer's spine and shoulder blade when worn; and wherein the sternal pad, wedge shaped sacral pad, and one of the one or more dorsal pads when in contact with a wearer's anatomy are arranged in a triangular configuration when viewed from a side perspective of a wearer.

19 Claims, 22 Drawing Sheets

D13

D14

(56) References Cited

U.S. PATENT DOCUMENTS

| | | | | |
|---|---|---|---|---|
| 5,954,250 | A * | 9/1999 | Hall | A45F 3/08 224/262 |
| 6,095,389 | A * | 8/2000 | Fenton | A45F 3/04 224/259 |
| D461,048 | S * | 8/2002 | Blanking | D3/216 |
| 6,634,533 | B2 * | 10/2003 | Thompson | A45F 3/047 224/262 |
| D507,697 | S | 7/2005 | Seong | |
| 7,726,530 | B1 | 6/2010 | Exposito | |
| 8,360,289 | B2 | 6/2013 | Thibadeau, Jr. et al. | |
| 8,708,206 | B2 | 4/2014 | Onessimo et al. | |
| 2002/0074374 | A1 | 6/2002 | Holbl | |
| 2005/0017041 | A1 * | 1/2005 | Roberts | A45F 3/04 224/642 |
| 2005/0205634 | A1 | 9/2005 | Han | |
| 2007/0251965 | A1 | 11/2007 | Mosley | |
| 2011/0108595 | A1 | 5/2011 | Hoag | |
| 2014/0289938 | A1 | 10/2014 | Brown | |
| 2015/0342325 | A1 | 12/2015 | Wright | |

FOREIGN PATENT DOCUMENTS

| | | | |
|---|---|---|---|
| EP | 0122764 | A3 | 10/1984 |
| EP | 0898907 | A1 | 3/1999 |
| FR | 2352513 | A1 | 12/1977 |
| WO | WO2013052670 | A1 | 4/2013 |

* cited by examiner

D1

D3

D4

$$\frac{a}{b} = \varphi = \frac{1+\sqrt{5}}{2}$$

D5

D6

D12

D13

D15

AD 2
Figure 20
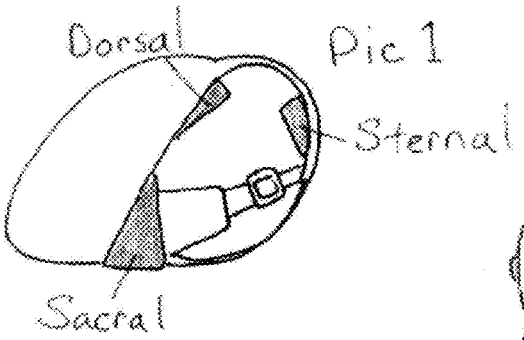
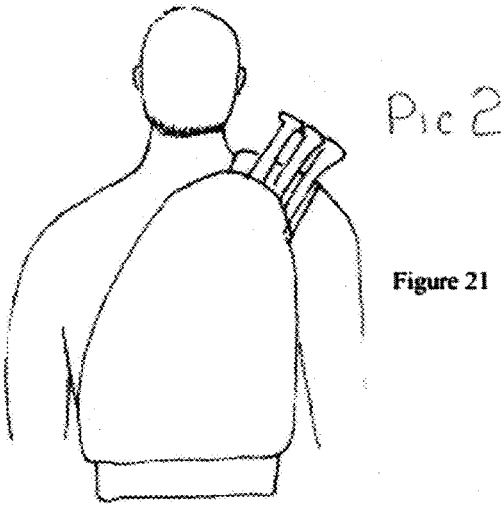
Figure 21
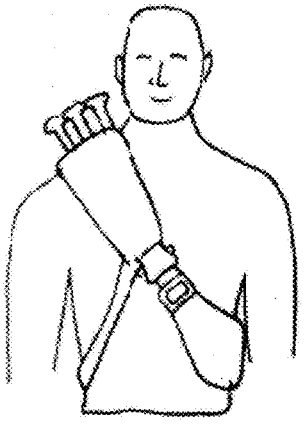
Figure 22
Pic 3

AD5

BACKPACK APPARATUS AND SYSTEM

BACKGROUND

Generally, a backpack design is disclosed herein. The backpack can be of any design, including single strap and double strap, and can be for any type of general or specific purpose, including but not limited to academic backpacks, business backpacks, computer or technology backpacks, audio/video equipment backpacks, luggage, travel backpacks, outdoor backpacks, hiking backpacks, survival backpacks, shooting backpacks, first-aid backpacks, medical equipment backpacks, child-care backpacks, athletic backpacks, and the like. Non-limiting examples of the athletic variety include an athletic bag, including baseball, softball, golf, lacrosse, field hockey, swimming, tennis, football, and any sport of activity having gear or equipment a user would want to carry. More specifically, a backpack design that may allow for a user to carry moderate to heavy weight over moderate distances. The term "center of gravity" (COG), as used herein refers to the center of the force of gravity through the human spine. It is to be understood that the COG may vary from individual to individual, but it is generally understood in the art that the COG of a human being in the standing position may be slightly anterior to the second sacral vertebra. This may place the COG inside the pelvis and anterior to the upper third of the sacrum in an adult. The center line of gravity may be a plumb line that is dropped from the opening of a person's ear (the COG of the skull) and travels through the COG located in the pelvis. The actual line of gravity may travel through the auricle of the ear, through the odontoid of the second cervical vertebra, the body of the seventh cervical vertebra, anterior to the thoracic spine, posterior to the third lumbar vertebra, through the COG of the entire upright human frame and down through the femoral heads. Ultimately, the line of gravity may also transect the knee and ankle joints, and may remain constant while the person is at rest and the spine is not loaded. See FIG. 1.

A person's COG may change following the placement of a typical two strap backpack, containing a moderate weight, as more weight is now present behind the line of gravity. The individual may offset this change in their COG by leaning forward slightly in an attempt to shift the weight of the pack closer to the line of gravity. In shifting the load in the backpack closer to the line of gravity, a person may now project their head forward by jutting the chin forward—the resultant posture is referred to as forward head posture (FHP). Conventional shoulder strap backpacks may promote the formation and development of FHP, and once a person develops this posture, the line of gravity may pass in front of all the anatomical structures discussed previously, thereby creating stress on those structures. The resultant posture (FHP) may be a clinical condition known to create the following: (1) compression; (2) weight bearing in the cervical and upper thoracic spine may be distributed through the bones and muscles; (3) muscle strain from the long lever fulcrum created by the FHP; and (4) damage to the spinal cord.

With respect to compression, for every inch the COG of the skull moves forward relative to the line of gravity, an additional ten pounds of compressive pressure is applied to the lower cervical intervertebral discs. Assuming the average FHP with a heavy pack is consistently about 2.5 to about 3.5 inches, the compressive forces applied to the bones and discs may be high enough to create inflammation and early onset degenerative disc disease. Compressive loads may be about 60% born by the vertebral body and disc and about 40% by the facet joints, and the magnified weight of the head created by FHP is also associated with early onset degenerative joint disease and degenerative disc disease (osteoarthritis). Muscle strain from the long lever fulcrum may cause myofascial pain. This myofascial pain may cause a wearer to increase their FHP in an attempt to relieve the discomfort. Neurologically, the development of chronic FHP has been shown to be devastating to the spinal cord, as the forward head posture and resultant loss in the normal cervical lordotic curve may be associated with neurological dysfunction and damage. Developmentally, all of the aforementioned are magnified in children and adolescents, as the developing spine is in a state of adaptation and plasticity. As such, children who spend large amounts of time in FHP, or who find themselves straining in a forward head position, may be at higher risk for the development of this posture as a permanent condition as adults. See FIG. 2.

In order to reduce the typical consequences of FHP a person may need to find ways to carry a load such that the body does not have to adopt an altered posture. This means either the load may need to be shifted or redistributed, or the line of gravity and/or the COG may need to be changed.

SUMMARY

In one aspect, a backpack for reducing forward head posture, is disclosed herein. The backpack including: one or more shoulder straps, where each of the one or more shoulder straps further includes a sternal pad in contact with a wearer's sternum and upper anterior ribs when worn; a wedge-shaped sacral pad comprising a first rectangular face, a second rectangular face, and a third rectangular face, where the first rectangular face further comprises an upper edge and a lower edge, the lower edge spanning a portion of a bottom of the backpack and the upper edge contacting a wearer's thoracolumbar junction when worn, where the second rectangular face is connected to a back portion of the backpack; one or more dorsal pads in contact with a wearer's spine and shoulder blade when worn; and where the sternal pad, wedge shaped sacral pad, and one of the one or more dorsal pads when in contact with a wearer's anatomy are arranged in a triangular configuration when viewed from a side perspective of a wearer, where the triangular configuration comprises an angle of about 72 degrees at an intersection of an invisible axis along a line extending from the triangularly-shaped sacral pad to the one or more dorsal pads and an invisible axis along a line extending from the sternal pad to the one or more dorsal pads, an angle of about 72 degrees at an intersection of an invisible axis along a line extending from the triangularly-shaped sacral pad to the sternal pad and an invisible axis along a line extending from the one or more dorsal pads to the sternal pad, and an angle of about 36 degrees at an intersection of an invisible axis along a line extending from the sternal pad to the triangularly-shaped sacral pad and an invisible axis along a line extending from the one or more dorsal pads to the triangularly-shaped sacral pad.

In some embodiments, the backpack includes two straps. In such embodiments, the one or more dorsal pads may include two dorsal pads arranged in a bilateral configuration such that the two dorsal pads are in contact with a wearer's spine and shoulder blades when worn. In other such embodiments, the one or more dorsal pads may include a single dorsal pad, wherein the single dorsal pad includes a recessed groove at a location where the single dorsal pad is in contact with the wearer's spine when worn so as to minimize weight bearing on the spine.

In some embodiments, the backpack includes one strap. In some embodiments, the backpack further includes an internal frame located at the same angle as the single strap, wherein the internal frame includes at least one cylinder-style opening proximate where the single strap passes over the wearer's shoulder when worn. In other embodiments, the internal frame includes a plurality of receptacle cylinders proximate a bottom portion of the backpack.

In some embodiments, the one or more dorsal pads are smaller than the wedge shaped sacral pad. In other embodiments, the sternal pad, wedge shaped sacral pad, and one of the one or more dorsal pads are constructed of foam, rubber padding, an air bladder, or any combination thereof.

In some embodiments, the one or more shoulder straps are about 4 inches to about 5 inches wide. In other embodiments, the lower edge of the wedge-shaped sacral pad spans an entirety of a bottom of the backpack. In still other embodiments, the one or more dorsal pads are triangularly shaped. In some embodiments, the one or more triangularly shaped dorsal pads face inferiorly downward to a wearer's T6 vertebra when worn. In other embodiments, the sternal pad acts as a fulcrum to offload a wear's shoulder and neck muscles when worn.

In another aspect, a backpack designed to reduce forward head posture is disclosed, where the backpack includes: one or more shoulder straps, wherein each of the one or more shoulder straps further comprises a sternal pad in contact with a wearer's sternum and upper anterior ribs when worn; a wedge-shaped sacral pad comprising a first rectangular face, a second rectangular face, and a third rectangular face, where the first rectangular face further comprises an upper edge and a lower edge, the lower edge spanning a bottom of the backpack and the upper edge contacting a user's thoracolumbar junction when worn, where the second rectangular face is connected to a back portion of the backpack; one or more dorsal pads in contact with a wearer's spine and shoulder blade when worn; and where the sternal pad, wedge shaped sacral pad, and one of the one or more dorsal pads when in contact with a wearer's anatomy are arranged in a triangular configuration when viewed from a side perspective of a wearer, where the triangular configuration is an isosceles triangle, with a longer first side and a second and a third side that are equal in length.

In some embodiments, the longer first side of the triangular configuration is 1.618 times longer than the second and the third sides of the triangular configuration.

In yet another aspect, a method of reducing forward head posture in wearer of a backpack, the method including: contacting a wearer's sternum and upper anterior ribs with a sternal pad included on one or more shoulder straps; contacting a thoracolumbar junction with an apex of a triangular-shaped sacral pad, such that an opposed linear portion of the triangular-shaped sacral pad spans at least a portion of a bottom of the backpack; and contacting a wearer's spine and shoulder with one or more dorsal pads, where the sternal pad, wedge shaped sacral pad, and one of the one or more dorsal pads when in contact with the wearer are arranged in a triangular configuration when viewed from a side perspective of the wearer.

Further features and advantages of the present invention will become evident to those of ordinary skill in the art after a study of the description, figures, and non-limiting examples in this document.

BRIEF DESCRIPTION OF THE DRAWINGS

FIG. 20 illustrates a right side view of an embodiment of the backpack closed.

FIG. 21 illustrates a rear view of the embodiment of FIG. 20 being worn.

FIG. 22 illustrates a front view of the embodiment of FIG. 20 being worn.

FIG. 28A illustrates various views of a triangular shaped pad. FIG. 28B illustrates various view of a half dome pad. FIG. 28C illustrates various view of a rectangular pad. FIG.

28D illustrates various view of a sloping pad. FIG. 28E illustrates various view of a round pad. The shape of the pads may influence comfort and the ability to shift the center of gravity of the load of the backpack.

DETAILED DESCRIPTION

Figure 1:
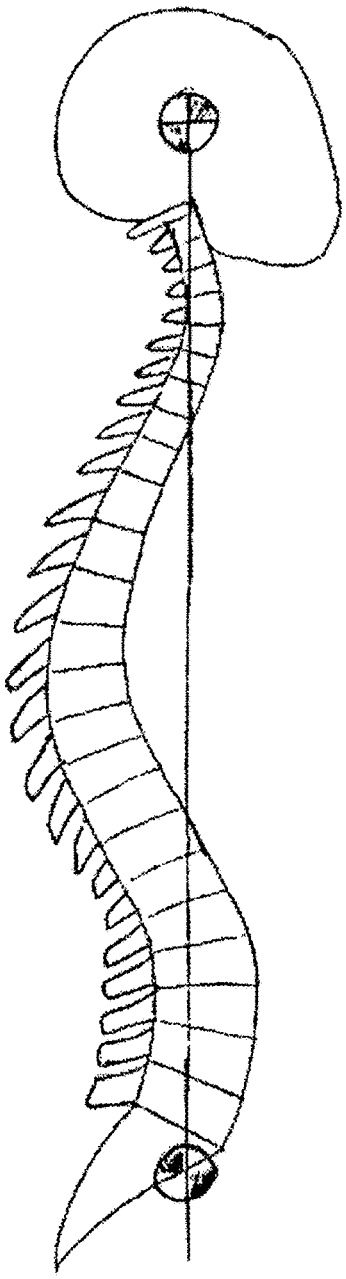
FIG. 1 illustrates the anatomical center of gravity (COG) for the spine.
Figures 2A, 2B:
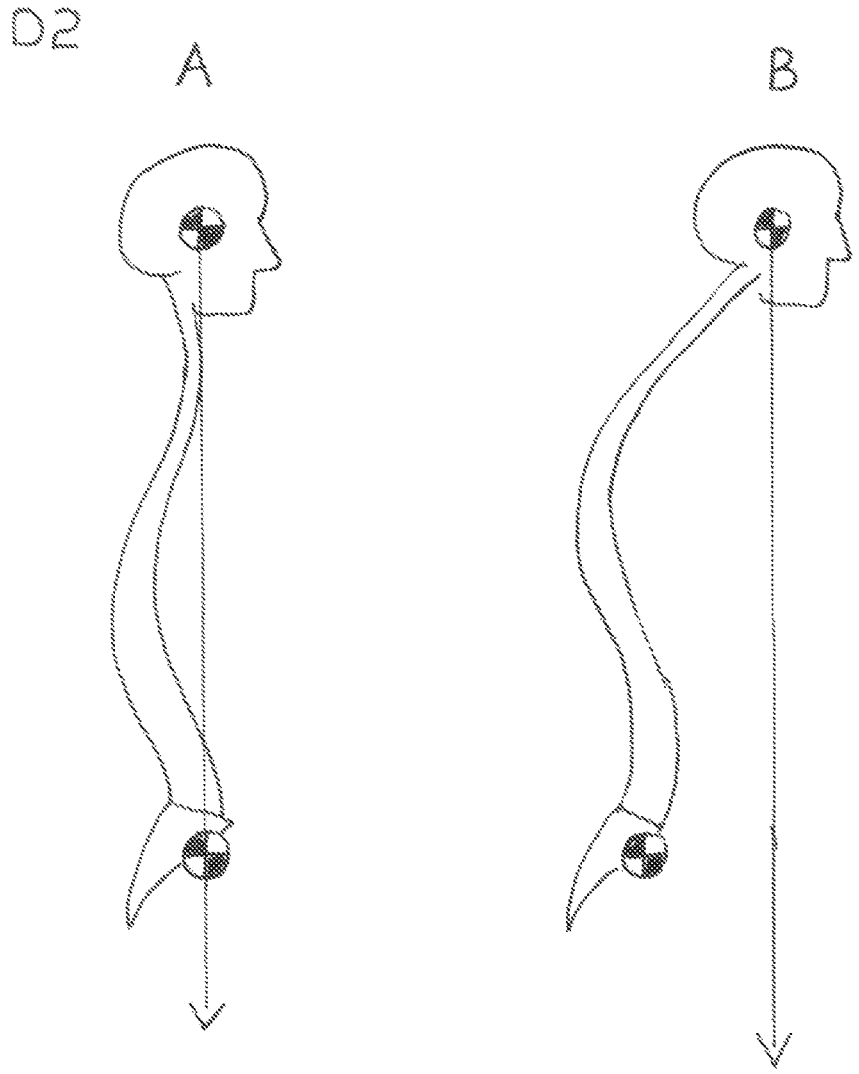
FIG. 2A illustrates the ideal gravity line traveling through the COG of the skull and the COG of the upright human.
FIG. 2B displays the effect of forward head posture (FHP) on the gravity line.

Referring now to FIG. 1, which illustrates an anatomical center of gravity (COG). This line, illustrated in FIG. 1, is a plumb line dropped from the center of gravity for the skull and passes through the COG of the human being. FIG. 2A illustrates an ideal gravity line traveling through the COG of the skull and the COG of an upright human, while FIG. 2B illustrates the effect of forward head posture on the gravity line.

Figure 4:
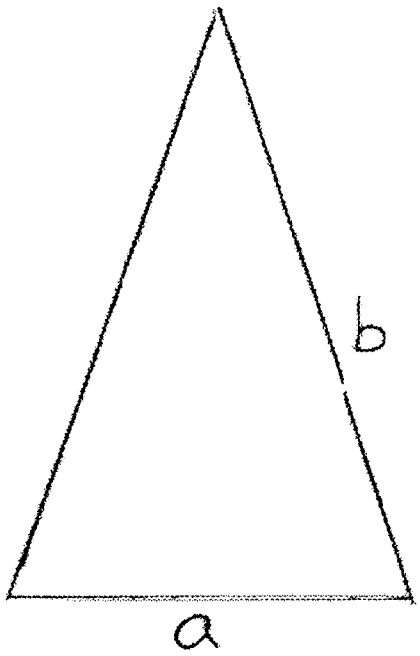
FIG. 4 is an example diagram of a golden triangle.

A shoulder padding system that may provide less forward head posture, less muscle strain, and may off load sensitive areas is disclosed herein. The placement and location of padding may affect these concerns. Placement and size of the padding may be determined solely by human anatomy, or may reflect natural geometric patterns. In some embodiments, but not all, the pad orientation that allows for best weight distribution is a triangle, specifically a geometric shape referred to as the golden triangle. A golden triangle is an isosceles triangle where the sides of the triangle are constructed by multiplying the length of the base by 1.618, as illustrated in FIG. 4. In the embodiment illustrated in FIG. 4 the longer side of the triangle (b) is 1.618 times longer than side (a).

This ratio (1.618) is known in mathematics as the golden ratio, and the basic concept of the golden ratio is a logarithmic proportion that occurs readily and repeatedly in nature. For example, the most famous and commonly cited occurrence of this proportion is the shell of a nautilus. The nautilus shell is an amazingly stable and strong design that can maintain its integrity while withstanding great pressure in the ocean's depth. As the rings or layers of a nautilus shell expand and curl there is a logarithmic proportion of expansion that reflects the Fibonacci ratio, 1.618, which is called phi in the world of mathematics. This ratio is identified over and over again in nature—the proportions in leaf growth and orientation, the arcs of rotation in flower pedals, circular seed orientations (such as that of a sunflower), the ratio and proportions of features on the human face, the length of the arm bones to forearm bones to hand bones to finger bones, all follow a recurring proportion of 1.618. The recurrence of phi may be a reflection and testimony to the strength and stability provided by this geometric orientation. Surprisingly, if the padding design reflected this geometric pattern, or similar patterns, the weight of the pack may be decreased in the wearer's perception and a sense of greater postural integrity ensued.

Figure 5:
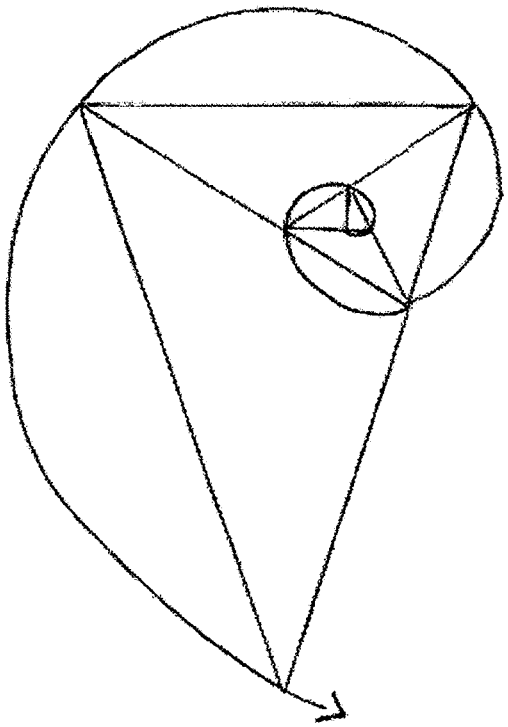
FIG. 5 illustrates an example embodiment of a formation of a golden spiral created by bisecting an initial triangle.
Figure 6:
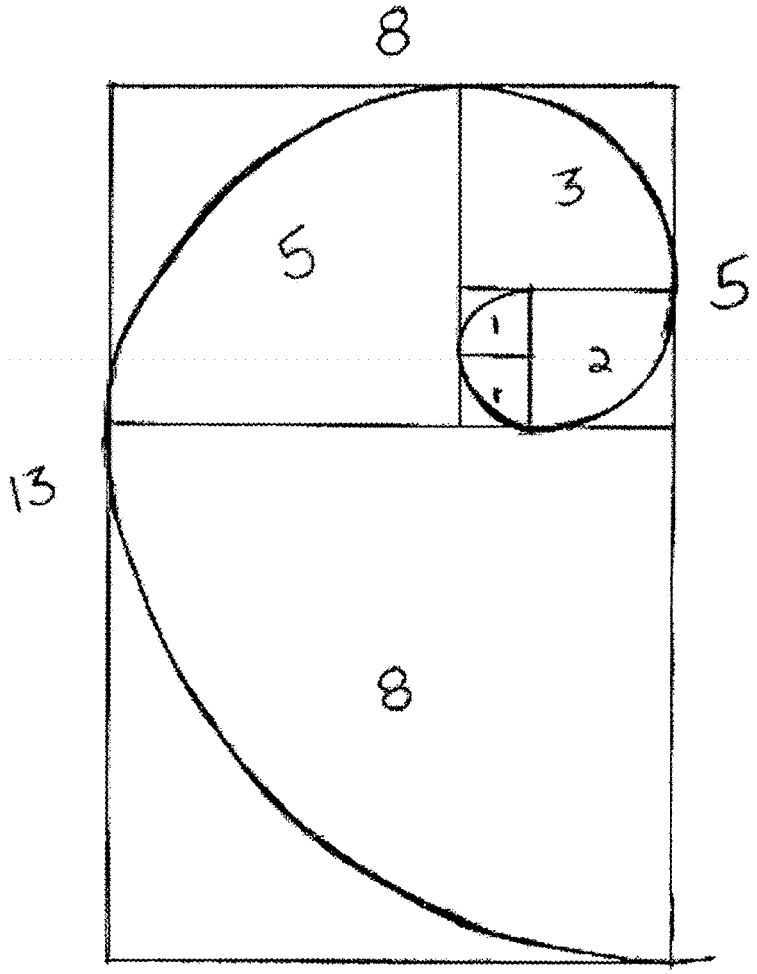
FIG. 6 illustrates an example embodiment of a golden rectangle.

FIG. 5 illustrates an example embodiment of a formation of a golden spiral created by bisecting an initial triangle, for example as illustrated in FIG. 4, to create a series of golden triangles and connecting said triangles with a spiral. Such a triangle series may follow Fibonacci's series. FIG. 6 illustrates an example embodiment of a golden rectangle, which is created by using the Fibonacci sequence and a golden spiral, for example as illustrated in FIG. 5, created by connecting a series of triangles made in the same ratio.

The geometric structure of a golden triangle can be used to construct another shape which reflects the golden ratio, a structure called the golden arc. An initial isosolese triangle can be bisected into smaller and smaller triangles, repetitively, wherein each of the smaller triangles will be golden triangles. This could be done to infinity, and all the newly formed triangles will have the same proportions as the original. Once a golden triangle has been formed repetitively a new application for the Fibonacci ratio or phi can be graphed throughout the triangles. This new shape becomes a spiral called the golden spiral. This arc is the shape reflected in shells, leaves, flower pedals, seed growth patterns, even the shape of galaxies. See FIGS. 5 and 6.

Figure 7:
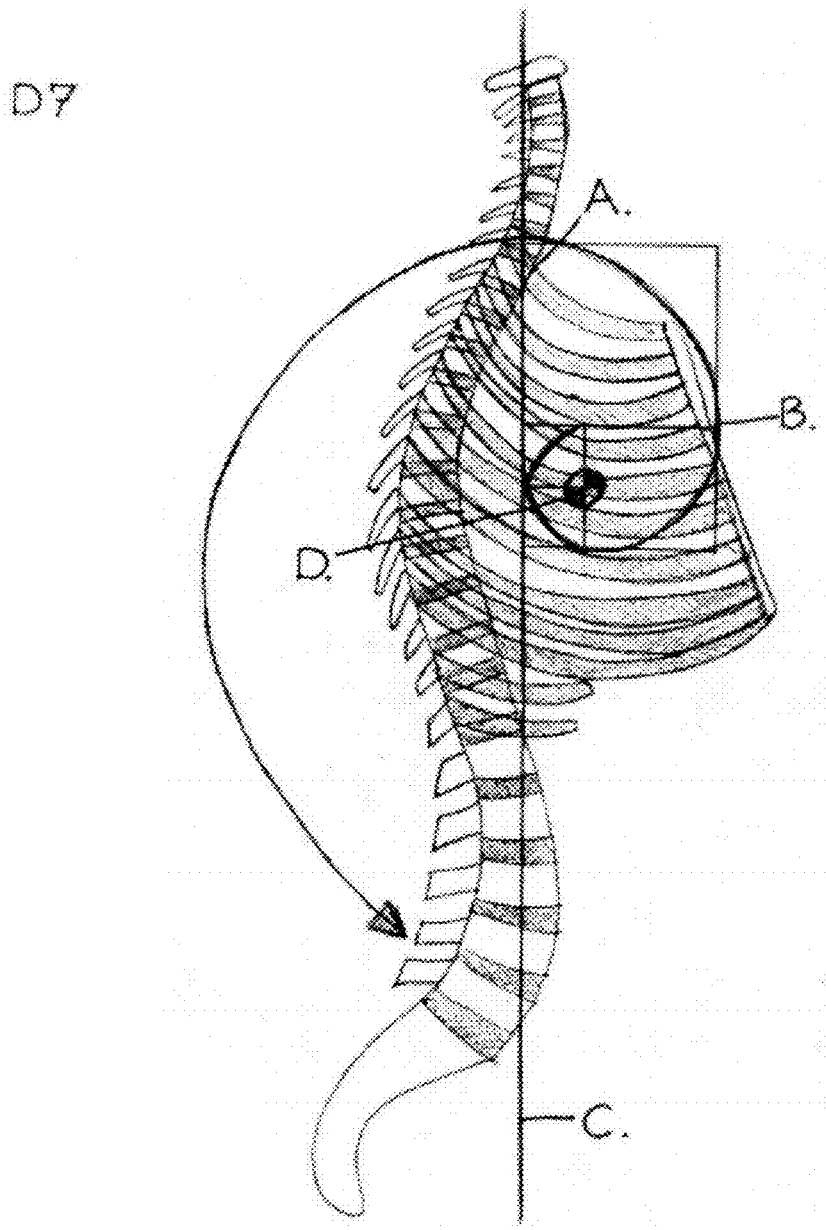
FIG. 7 is an example diagram showing a golden spiral generated by creating a series of rectangles, as in FIG. 6.

Referring now to FIG. 7, which is an exemplary diagram illustrating a golden spiral generated by a series of rectangles. In the illustrated example, landmarks used to create rectangles were the first rib, the sternum, gravity line (see FIG. 1), and the center of gravity for a human ribcage. This spiral displays a circumducting force that approximates how a regular backpack affects the center of gravity of a person wearing the pack. The force vector, in this example, is directed in a backwards and downwards motion, approximating a wearer's experience. A first rib and sternum were utilized in this example as they may be the weight bearing elements used to carry a backpack, and carrying a weight along the gravity line is the body's preference. Reference markers are as follows: (A) first rib; (B) sternum; (C) Center of Gravity (COG) line; and (D) COG of ribcage.

A triangular orientation in a backpack design may be formed by connecting the placement of the pads based on human anatomy. Once an initial triangle was configured into a golden triangle (where the angles are 72 degrees, 72 degrees and 36 degrees), the transposition of the golden arc over the lateral view of the human anatomy revealed a force vector that seemed to reflect both the problem and the solution. The problem could be diagrammatically represented by finding the COG of the ribcage and using the first rib and the sternum (weight bearing points for a typical backpack) and creating a Fibonacci rectangle and deriving the subsequent golden arc. See FIG. 7. An arc derived by creating a golden rectangle by using the gravity line, the first rib (where backpack weight bearing occurs) and the COG of the ribcage proper. This arc displays the force at work on the human frame while wearing a typical backpack.

The arc illustrated in FIG. 7 reflects a common problem posed by most conventional backpacks; the weight pulls backwards and inferiorly as an arcing force in a manner which causes people to lurch forward in an attempt to balance the force. This posterior and downward force vector creates shoulder discomfort making the wearer bend forward to alleviate pain as well as balancing the load.

For ease of discussion herein, conventional backpacks may be of a two strap design. Weight loaded into the bag usually ends up in the bottom of the pack, due to various components (e.g. in baseball backpacks, the barrels of bats and other equipment) settling into the bottom of the bag. This may result in a downward force that pulls the shoulders back, therefore creating the altered posture and strain previously mentioned. A single strap bag may have several advantages, including the ability to displace the vector of force applied by the pack from a sagittal plane (Y axis) to an oblique vector circumducted around the sagittal, corona, and transverse planes (X, Y, Z axis). An oblique three dimensional orientation of the strap disperses weight across more individual muscles and muscle groups lying in different orientations relative to the force produced by the load. In other words, the use of an oblique strap uses the bony structure of the ribcage and pelvis to allow oblique lashing friction to carry the weight.

Conventional baseball bat carrying arrangements tend to be mesh pockets on the side of a bag. Several disadvantages may be readily noted with this location; for example, the barrels of the bats are lateral and posterior to the spine, thereby pulling the entire pack downward and destabilizing COG. As a wearer of a backpack walks with such a bag, the phenomenon of FHP occurs and the handles of the bats sway forward, backward, and side to side, producing angular moments that the torso must stabilize. Furthermore, with such a bat orientation there is a risk that the handles of the bats may strike other people and/or objects whenever a wearer bends forward or maneuvers themselves into postures other than strictly upright.

Figure 3:
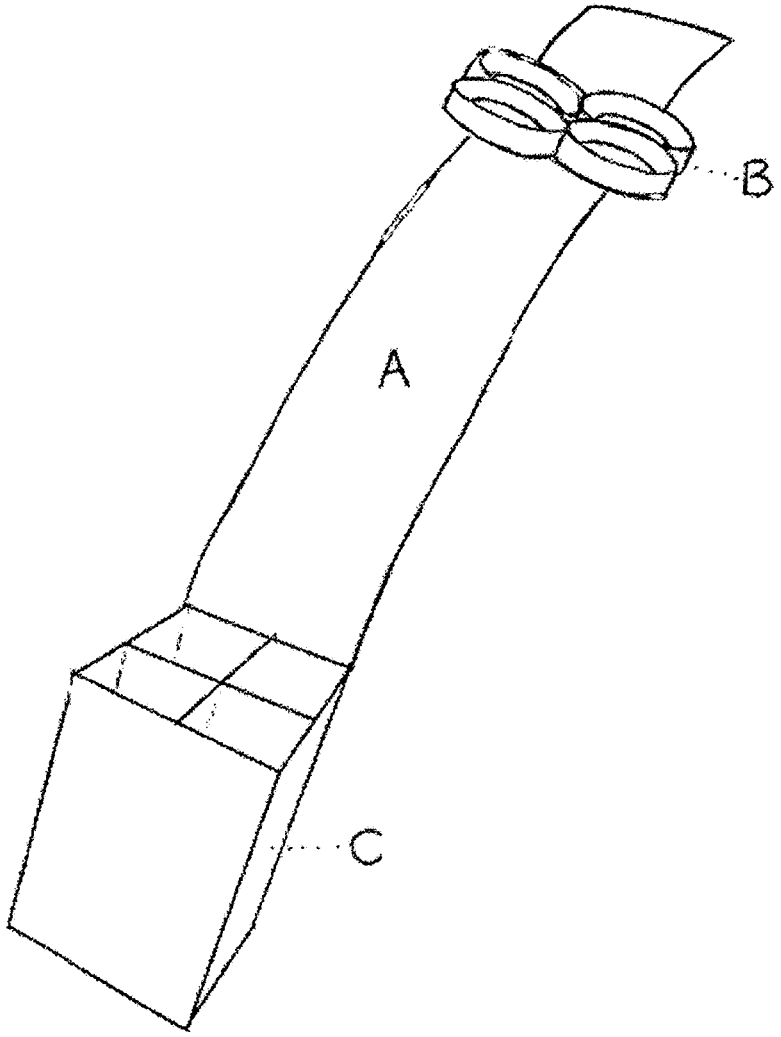
FIG. 3 illustrates an example embodiment of an internal bat compartment for use in a baseball bag.

Referring now to FIG. 3, an example embodiment of an internal compartment bat compartment for us in a baseball bag is illustrated. FIG. 3 is labeled as follows: (A) represents a single strap that runs through the center of the pack; (B) represents open rings at the top of a bag where the bats are inserted, which may hold the handle of the bats after being inserted into the bag; (C) represents receptacle cylinders for one or more barrels of bats located at bottom of the bag.

In the baseball backpack embodiment of the present disclosure, the bats may be at the bottom of the bag seated in cupped slots or receptacles C. The shafts of the bats are centrally located, with an oblique orientation that may allow for improved ergonomics and control. One embodiment of such a bag may involve an internal frame located at the same angle as the oblique single strap, where the barrels of oriented diagonally where the handles pass through cylinder style openings near the top of the bag where the single strap passes over the shoulder. The bats may be right up against the front of the pack, and therefore closer to the spine, which may reduce the lever arm of a posteriorly located weight, allowing for better control of the bats and less perceived weight by the carrier. In some embodiments, the cylinder will not be complete throughout the bag in a hard shell, but instead involve a cup for the barrels at the bottom of the pack and an open ring at the top of the bag with a fabric sewn continuously to allow the bat to be loaded and removed from the top. In some embodiments, these cups and rings of these cylinders are made of collapsible foam, or other compressible material, for efficient use of space. In some embodiments, four receptacle cylinders for bats may be provided near a bottom portion of the bag (see FIG. 3), and this may accomplished in a two bats wide, two bats stacked orientation. In other embodiments, any other number bat slots as deemed necessary in the art may be provided, for example two, three, five, or so on bat slots may be provided. In some embodiments, the final orientation of the bat knobs may be slightly behind and level with a wearer's head, and the bats may be stabilized in such a manner as to avoid collisions, may not sway laterally and may be right up against the spine as close to the COG as possible. The weight of the bats may be in line with the strap that circumducts the torso across three anatomical planes therefore taking advantage of using multiplane musculature and the bony ribcage to carry the load. See FIG. 3.

The various embodiments of pad shapes and orientations described herein may lift and shift the load and offload those key areas of the human anatomy that may be most stressed when using a conventional backpack. In various embodiments, padding used may be of varying shaping, composed of varying material, and be of varying densities. The pad placement may offload sensitive tissues and project the COG of the load forward so the wearer does not have to by misusing their body. The pad placement orientations for a single strap design backpack are described herein.

A sacral pad may span the bottom of the bag horizontally. In some embodiments, the pad may be shaped like a triangle with the base of the triangle at the bottom of the bag and the apex of the triangle ending at the thoracolumbar junction. A sacral pad may fill in the gap anatomically created by the lumbar lordosis in human beings. The base of the pad, for example a triangle, at the bottom of the bag allows the weight of the bag (usually at the base of any bag) to be 'lifted' in order to decrease the perceived pack weight and transfer the load superiorly to offload the shoulder/neck muscles. This may effectively lift the COG of the weight of the bag and tilts the load forward closer to the COG line of a standing person decreasing the lever arm created by a heavy pack. Such a sacral pad may also span the entire width of the low back without a gap in the pad for the spine so that the entire width of the posterior aspect of the pelvis can carry the weight, which may protect the sacroiliac joints.

A dorsal pad may be placed on the upper dorsal ribs between the spine and shoulder blade on the side of the single strap. The apex of this triangular pad may face inferiorly down to the T6 vertebra, and the base of the triangle may be superior such that the shoulder straps are 'lifted' off the trapezius and levator scapulae muscles. Such a pad may be smaller and thinner than the sacral pad and may act in conjunction with a sternal pad to off load the shoulder structure. In addition to an offloading function, this pad may also lift the weight of the pack and transfer the COG of the back pack closer to an ideal carrying angle.

Figure 8:
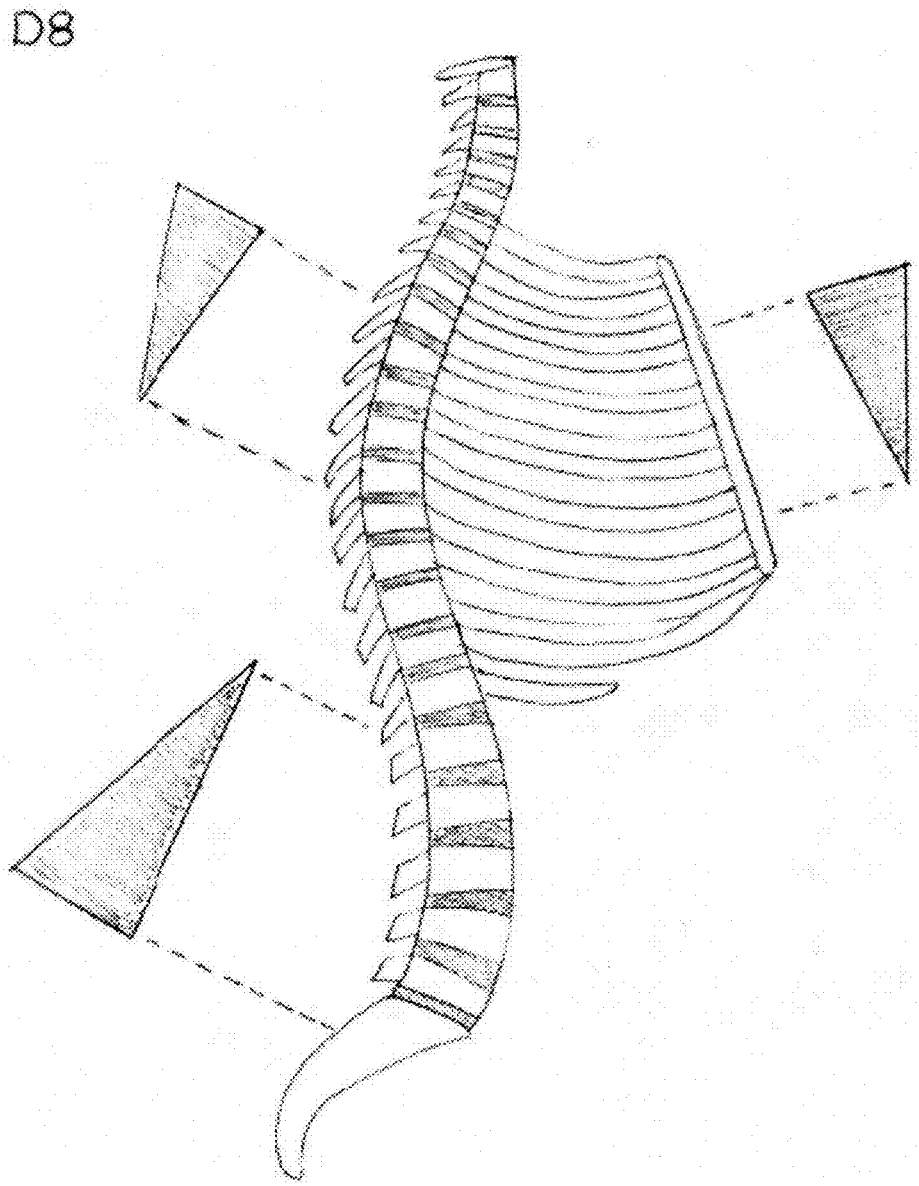
FIG. 8 is an example schematic of the shapes and placement of padding on a human frame.

Referring now to FIG. 8, an exemplary schematic of the shapes and placement of padding on a human frame is illustrated. A sternal or breastbone pad may be placed in the single strap as a triangular pad with the base of the triangle facing superiorly and the apex of the pad facing inferiorly such that the larger aspect of the padding acts to lift the strapping off the shoulder structure. Ideally, this pad may act as fulcrum, and may operate in conjunction with a dorsal pad to offload the shoulder/neck muscles and may operate in conjunction with a sacral pad to lift the weight of the pack thereby changing the center of gravity of the load being carried. Although FIG. 8 is two dimensional, such a design would allow for an oblique three dimensional orientation of the pads.

Figure 9:
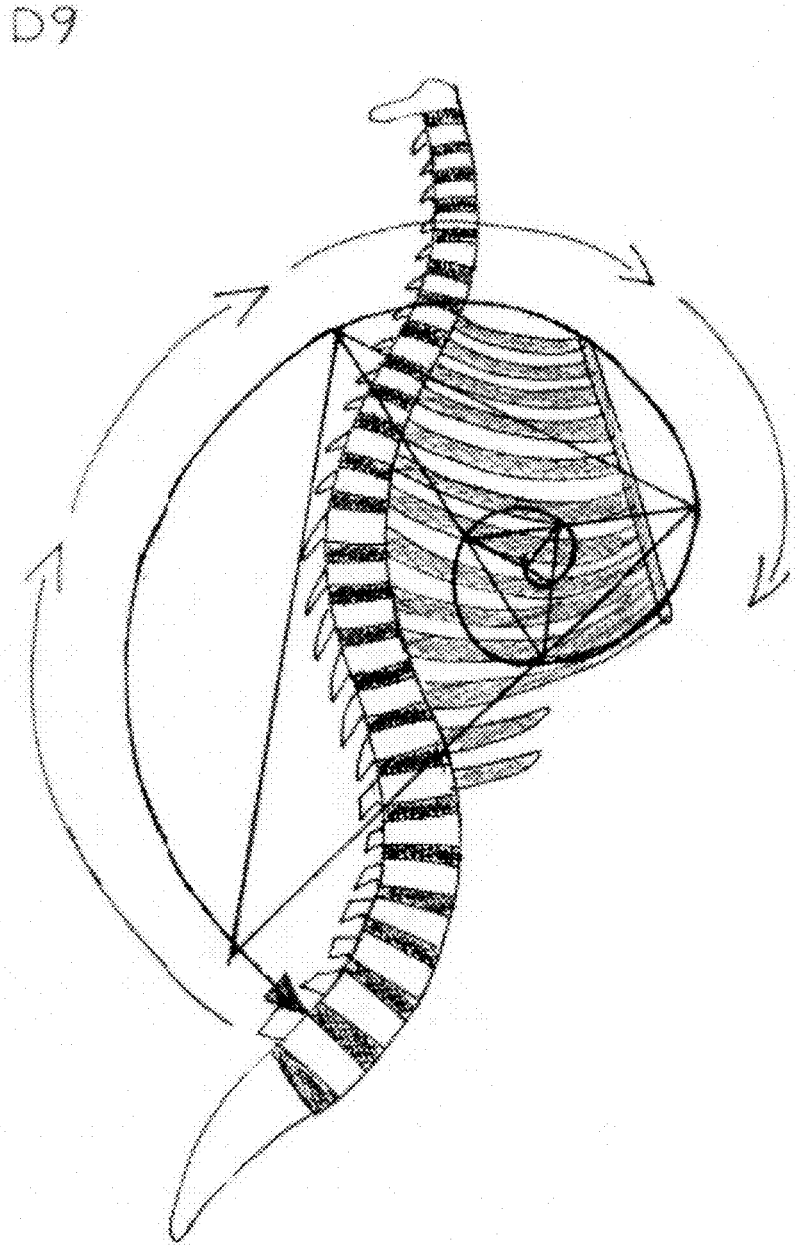
FIG. 9 is an example illustrating a force vector, similar to that in FIG. 7.

Referring now to FIG. 9, an exemplary force vector, similar to that of FIG. 7 is illustrated. The illustrative example of FIG. 9 was generated using a schematic of the approximate placement of the pads in FIG. 8, the placement of pads as illustrated generates a series of golden triangles and a spiral is generated. This spiral may be directed upwards and forwards due to the impulse created by the three pads placed in their proper orientation. FIG. 9 represents a counter-rotational force to that seen in FIG. 7, as a wearer experiences carrying this pack.

Figure 10:
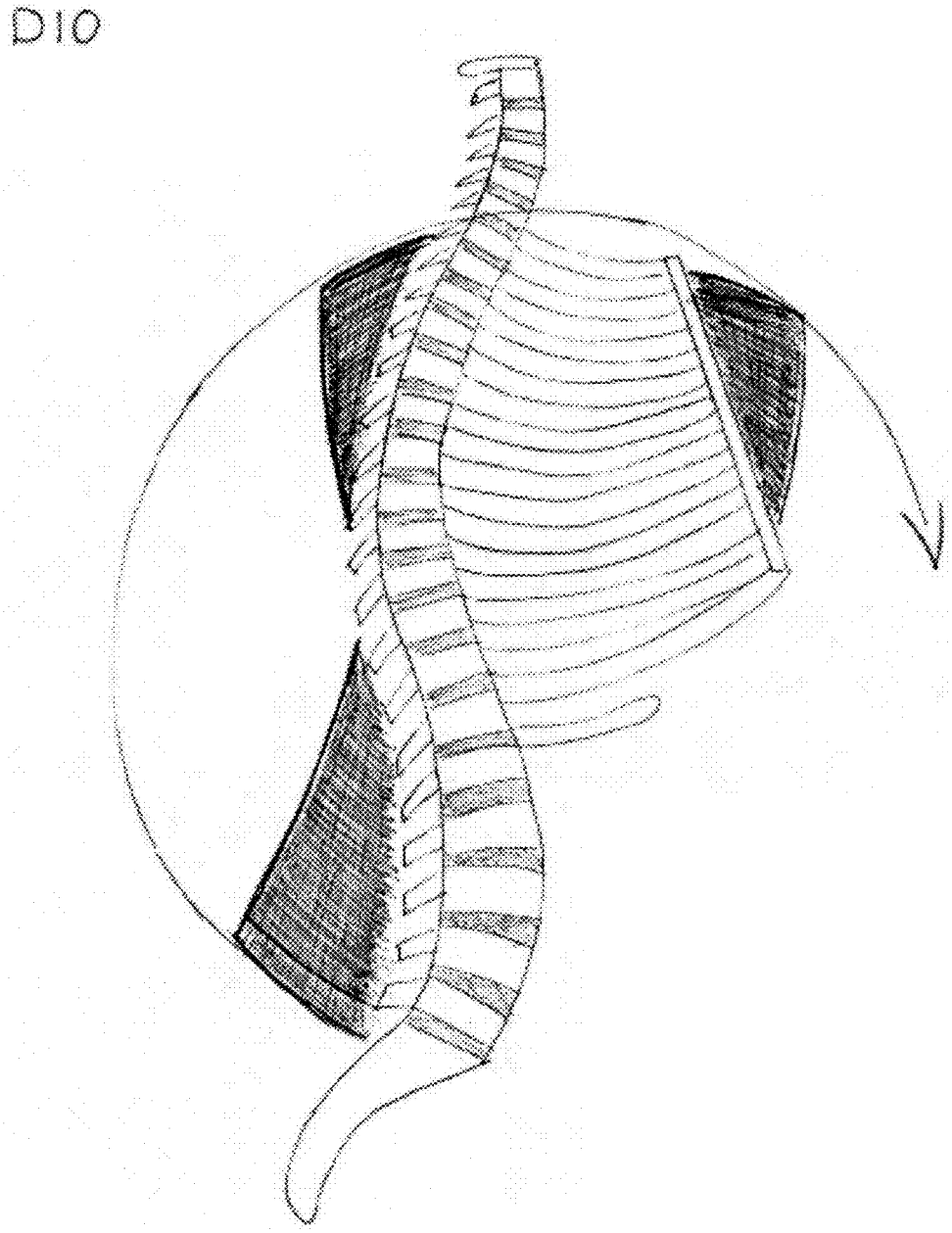
FIG. 10 illustrates a simplified embodiment of the forces implied in FIG. 9 with example embodiments of padding.

In some embodiments, the use of triangular pads, also shaped as golden triangles, may provide forces in the opposite direction but along the same arc, thereby providing a wearer a sense of a lighter load. Although, it is not possible to nullify the effects of gravity, placing isosolece triangle padding in the orientation of a large triangle circumducting the torso, via a single strap lashing, may provide a countering force to the problematic orientation of a conventional backpack. A pack equipped with these triangular pads, placed in a shaped of a large golden triangle may be effective at reducing shoulder discomfort, muscle strain and forward head posture. The pad shape and orientation attempts to create a counter rotational force vector, in the shape of a golden arc, which provides a force that counters the typical gravitational average experienced when wearing a non-padded two strap backpack, as shown in FIG. 9. The golden arc created from this triangle falls in the same are as that demonstrated in FIG. 7. Additionally, FIG. 10 illustrates an example of proper pad placement and the implied counter rotational lift that a wearer of the backpack may feel while wearing a single sling pack.

Figure 26:
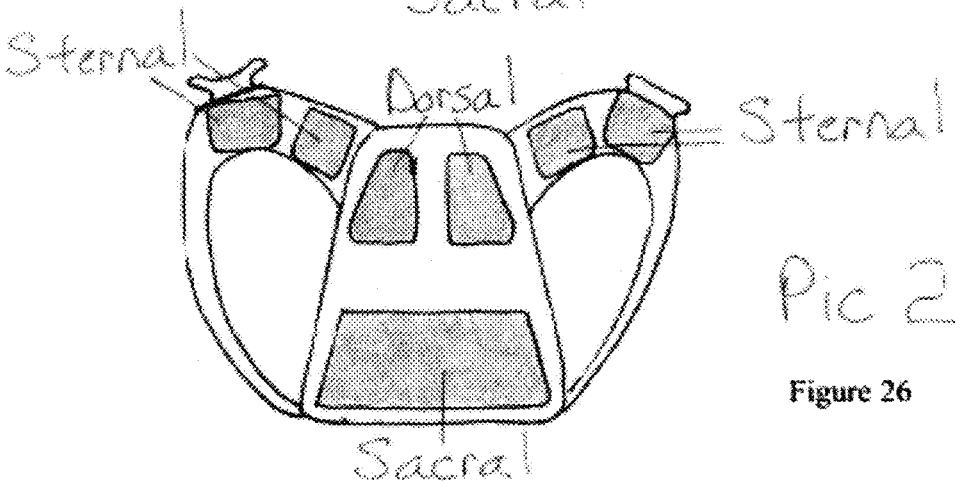
FIG. 26 illustrates a front view of the embodiment of FIG. 25 with shoulder straps deflected away to the sides.

FIG. 26 illustrates various examples of embodiments of the shape of pads. FIG. 26A illustrates various views of a triangular shaped pad. FIG. 26B illustrates various view of a half dome pad. FIG. 26C illustrates various view of a rectangular pad. FIG. 26D illustrates various view of a sloping pad. FIG. 26E illustrates various view of a round pad. The shape of the pads may influence comfort and the ability to shift the center of gravity of the load of the backpack. These are not intended to be limiting, as any other shapes known in the art may be used. Furthermore, in some embodiments, the pad may be constructed of foam, for example polyurethane foam, neoprene, or any other type of foam or rubber padding material known in the art, or any combination thereof. In other embodiments, the density of the foam, neoprene, rubber, or other padding material known in the art may vary. In still other embodiments, the padding may be constructed at least partially of an air bladder.

Figure 29:
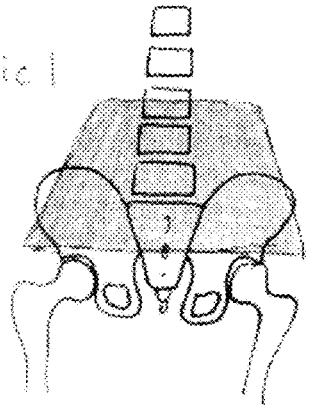
FIG. 29 illustrates an embodiment of a rear view of an adult human pelvis, with sacral pad placement.
Figure 30:
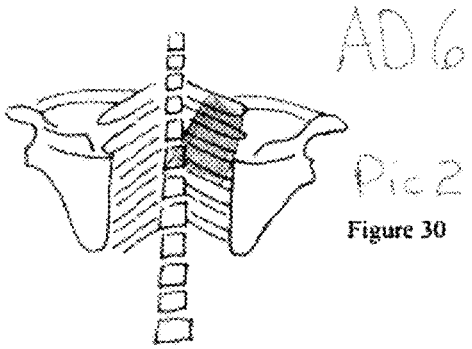
FIG. 30 illustrates a rear view of an embodiment of an upper ribcage, spine, and both shoulder blades of an adult human with pad placement for a single strap embodiment.
Figure 31:
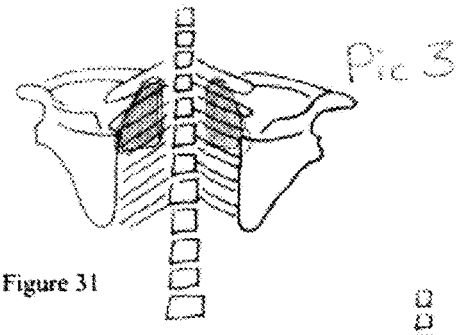
FIG. 31 illustrates a rear view of an embodiment of an upper ribcage, spine, and both shoulder blades of an adult human with pad placement for a two strap embodiment.
Figure 32:
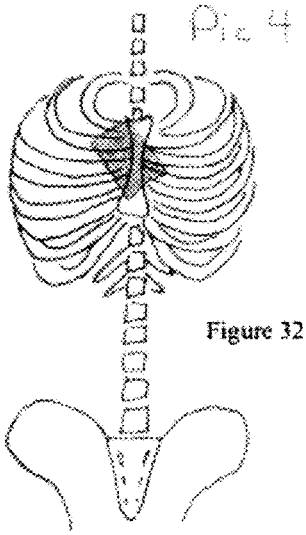
FIG. 32 illustrates a front view of an embodiment of a human ribcage, including the breastbone (sternum) with pad placement for a single strap embodiment.
Figure 33:
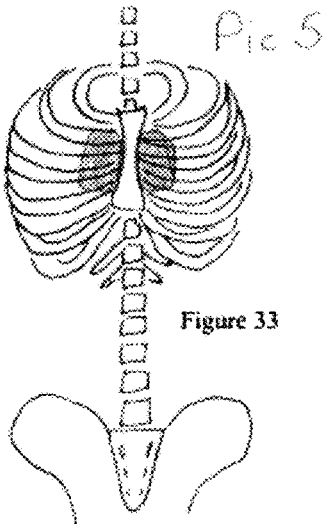
FIG. 33 illustrates a front view of an embodiment of a human ribcage and spine, and illustrates the location and orientation (shaded area) of pads used in a two strap embodiment.

FIGS. 29-33 illustrates exemplary embodiments of the various padding described herein relative to the human anatomy. Specifically, FIG. 29 illustrates a rear view of an adult human pelvis, with sacral pad placement, the shaded portion, this allows the sacral pad to rest on boney anatomical features. Such an orientation may give the sacral ramp pad the ability to lift the weight of the bag superiorly without using muscle exertion. The sacral ramp pad may use a solid bone contact as a push off surface to lift weight and shift the center of gravity of a bag superiorly and forward. FIG. 30 illustrates a rear view of an upper ribcage, spine, and both shoulder blades of an adult human. In this embodiment, a single strap design is illustrated, with the contact surface on the body as the upper ribs between the spine and the shoulder blades (as shaded). This allows the bone elements to carry and distribute the weight of a backpack. This pad location, in combination with the sternal pad location (in the front on the sternum), may allow the backpack to offload the upper back muscles (trapezius, levator scapulae). FIG. 31 illustrates a rear view of an upper ribcage, spine, and both shoulder blades of an adult human. Shaded areas are bilateral to display the dorsal pad placement of a two strap backpack design. This pad may go across the upper back and have a recessed groove as to not weight bear directly on the spine. The size and shape of the pads may vary, but the orientation may remain constant. The placement of the pads on the upper dorsal ribs may be facilitate the ability of the backpack to off load the muscles usually stressed by wearing a backpack. FIG. 32 illustrates a front view of a human ribcage, including the breastbone (sternum). Shaded area designates an embodiment of a placement of a sternal pad in a single strap backpack design. The contact surface for this pad is the middle and upper aspect of the sternum, the upper right anterior ribs. The pad angle and shape may be any of the pad shapes discussed herein, but placement of the pad may remain constant. A sternal pad in conjunction with a dorsal pad may be responsible for offloading the upper back muscles commonly stressed by a conventional backpack. These two pads may vary in shape, firmness and overall size, but the placements on the aforementioned boney features may remain constant. FIG. 33 illustrates a front view of a human ribcage and spine, and illustrates the location and orientation (shaded area) of sternal pads used in a two strap embodiment. The anatomy contacted is the sternum and the upper medial anterior ribs. This padded area may be divided into two individual pads, each located under each half of the clasp that encloses in a cinching manner over the wearer's chest.

While described herein in terms of a baseball bag, it is to be understood that the embodiments described herein are not so limited and may be utilized in any type of backpack utilized for any type of general or specific purpose. For example, the various embodiments of padding disclosed herein may be utilized in an academic backpack, a business backpack, a pack used for travel, outdoor activities (e.g. hiking), or sports, including baseball, softball, golf, lacrosse, field hockey, swimming, tennis, football, and any sport of activity having gear or equipment a user would want to carry etc. For example, in other embodiments, the various elements described herein may be utilized in conjunction with a golf bag, with various embodiments of padding described herein included on the straps of a golf bag. Furthermore, it is to be understood that the various pads and padding arrangements described herein may be utilized with either a single strap pack or a two strap pack.

Figure 11:
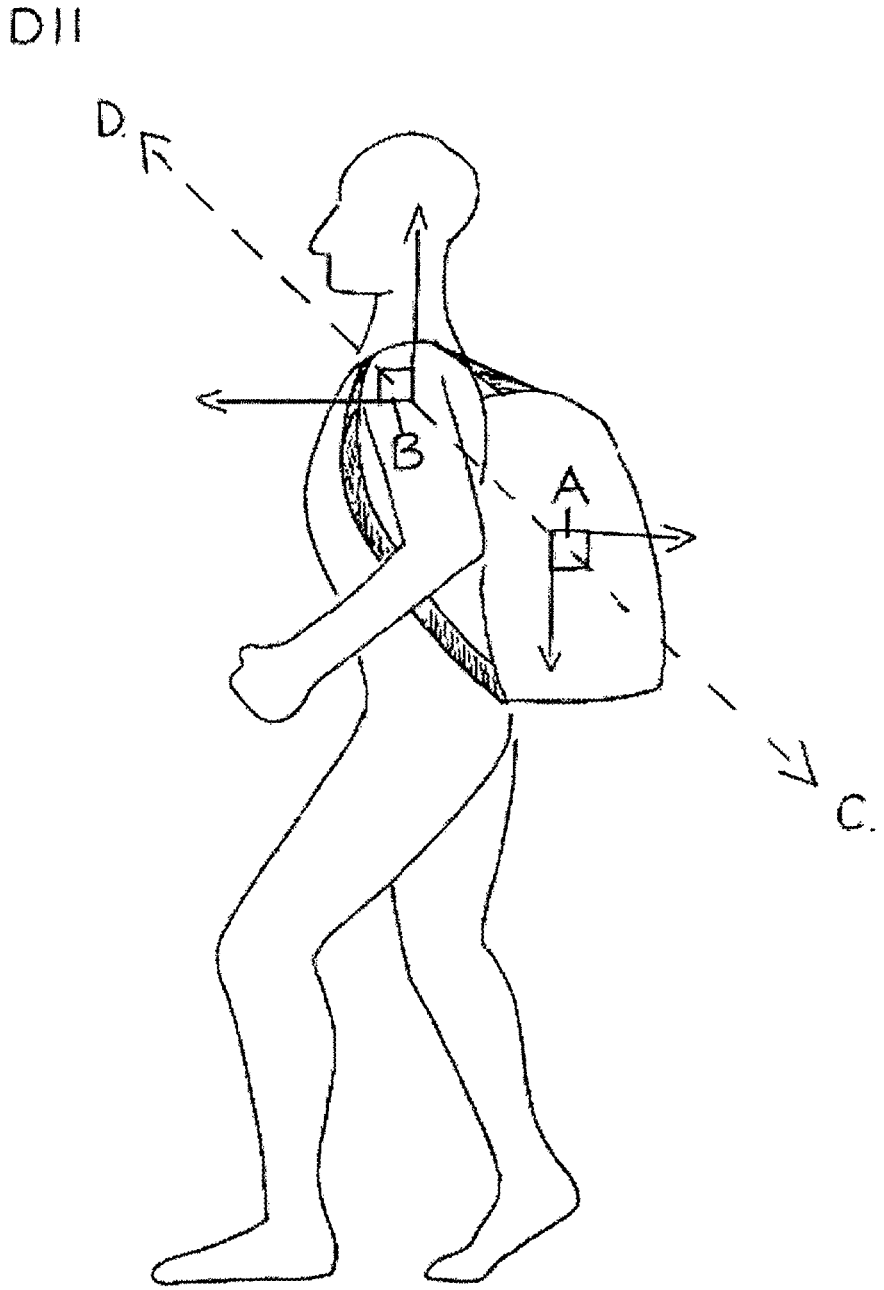
FIG. 11 illustrates forces that may be required for a person to carry a load through the use of a conventional (prior art) backpack.

Any weight carried in a backpack will create a need for a counter vector on behalf of the wearer of the pack. FIG. 11 illustrates forces that may be required for a person to carry a load through the use of a conventional (prior art) backpack. Illustrated on FIG. 11, are: (A) center of gravity of weight in pack; (B) anterior/superior shoulder where the weight is carried; (C) resultant vector that places stress on a human frame to carry the weight; and (D) counterforce vector that a carrier must generate to carry the pack. The vector created by the weight of the backpack necessitates the opposite force be created by the wearer. That opposing force is usually achieved by the formation of FHP and muscle strain. If the weight in the backpack is placed too low in the backpack compartments, a compressive force is generated and may create shoulder discomfort. If the weight in the backpack is too high and/or too posterior in its location a wearer of the pack may have to generate a significant forward force to carry the pack.

Figure 12:
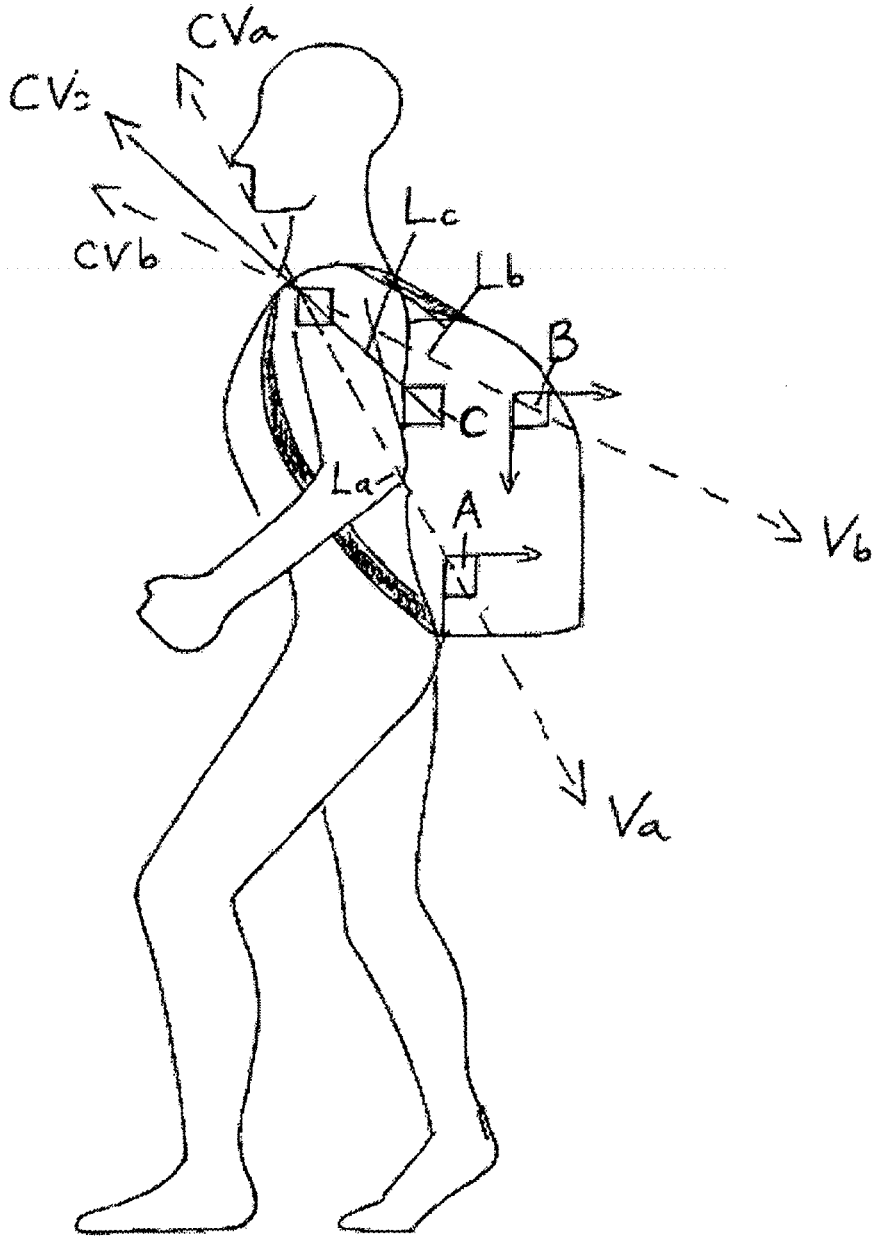
FIG. 12 is an illustrative example of various force vectors that may be created depending on the location of a load orientation in a backpack.

Mathematically, the ideal position for the weight in a backpack is higher and closer to the gravity line of the carrier. FIG. 12 illustrates an example of various force vectors that may be created depending on the location of a load orientation in a backpack. For example, a lower weight orientation (A) may create an accentuated downward force on the shoulder, while a higher and more posterior orientation (B) may create a force that pulls a wearer backwards. Both (A) and (B) act on a shoulder with a long lever arm, which may be the distance between the load and the shoulder. Reference (C) may be the ideal placement for weight in a backpack to minimize strain due to vector forces. Reference markers are as follows: (A) lower weight; (Va) vector force of weight (A); (La) lever arm of weight (A); (CVa) countering vector force for weight (A); (B) higher posterior weight; (Vb) vector force of weight (B); (CVb) countering vector force for weight (B); (C) ideal weight placement; (Vc) vector force of weight (C); (Lc) lever arm of weight (C); (CVc) countering vector force for weight (C). The resultant force for any backpack regardless of the weight orientation is a backwards pull on top of the shoulders, on the front of the chest and downward on the low back.

Figure 13:
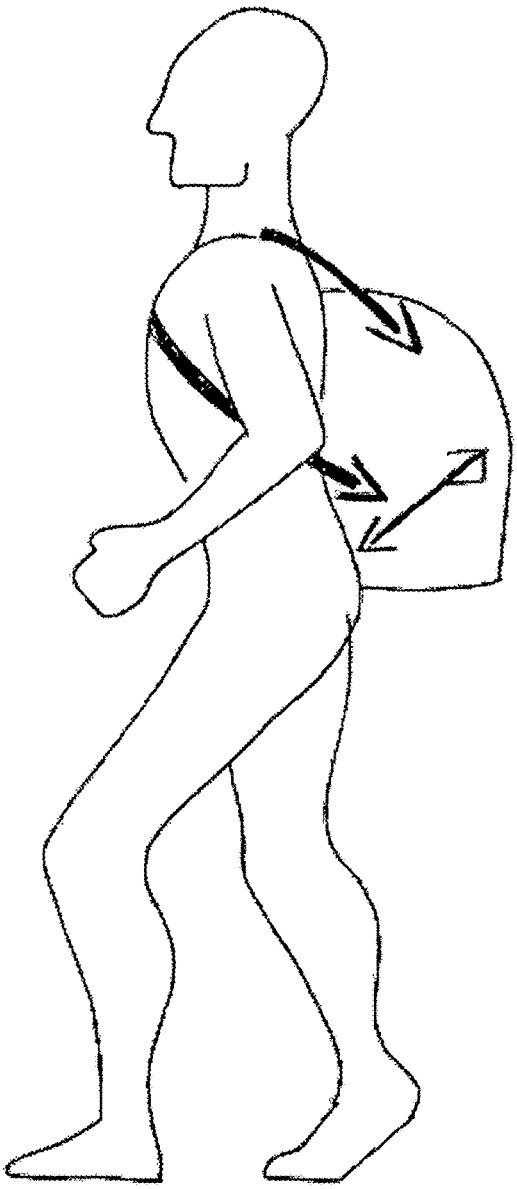
FIG. 13 is an illustrative example of forces that are measurably placed on a human frame in order to accomplish the task of carrying a backpack.

FIG. 13 illustrates exemplary forces that are measurably placed on a human frame in order to accomplish the task of carrying a backpack. The force vectors placing contact stress on a human frame may be where pads are located in various embodiments disclosed herein.

Figure 14:
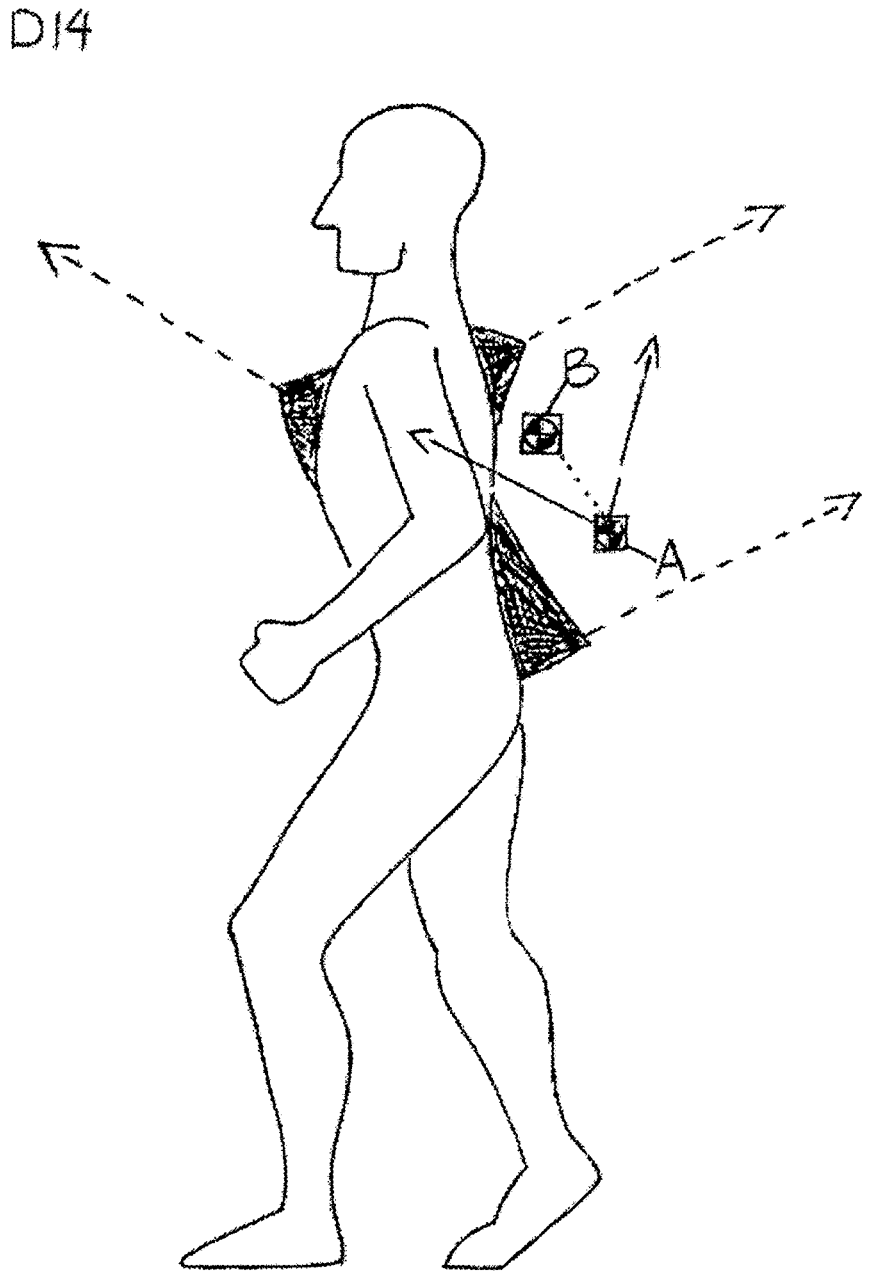
FIG. 14 is an illustrative example of a net effect of wearing a bag with a pad orientation outlined in various embodiments described herein.

The pad placement described herein is strategically oriented to create lift for all three of these forces. In contrast, FIG. 14 illustrates the pad locations in an embodiment of this backpack disclosed herein and the associated counter the forces. Each pad may exert a force on the strap carrying the load in a backpack. These forces are represented by vector arrows displayed: (A) average location of a load in a conventional (prior art) backpack, see FIG. 12; (B) illustrates a location of weight in the pack after the force vectors of various embodiments disclosed herein have lifted and shifted the weight. The actual net effect may be difficult to calculate precisely due to a multitude of factors, including the height and build of a person carrying the backpack, the weight of the backpack, how the backpack is loaded, and the postural integrity of the individual carrying the backpack.

Figure 15:
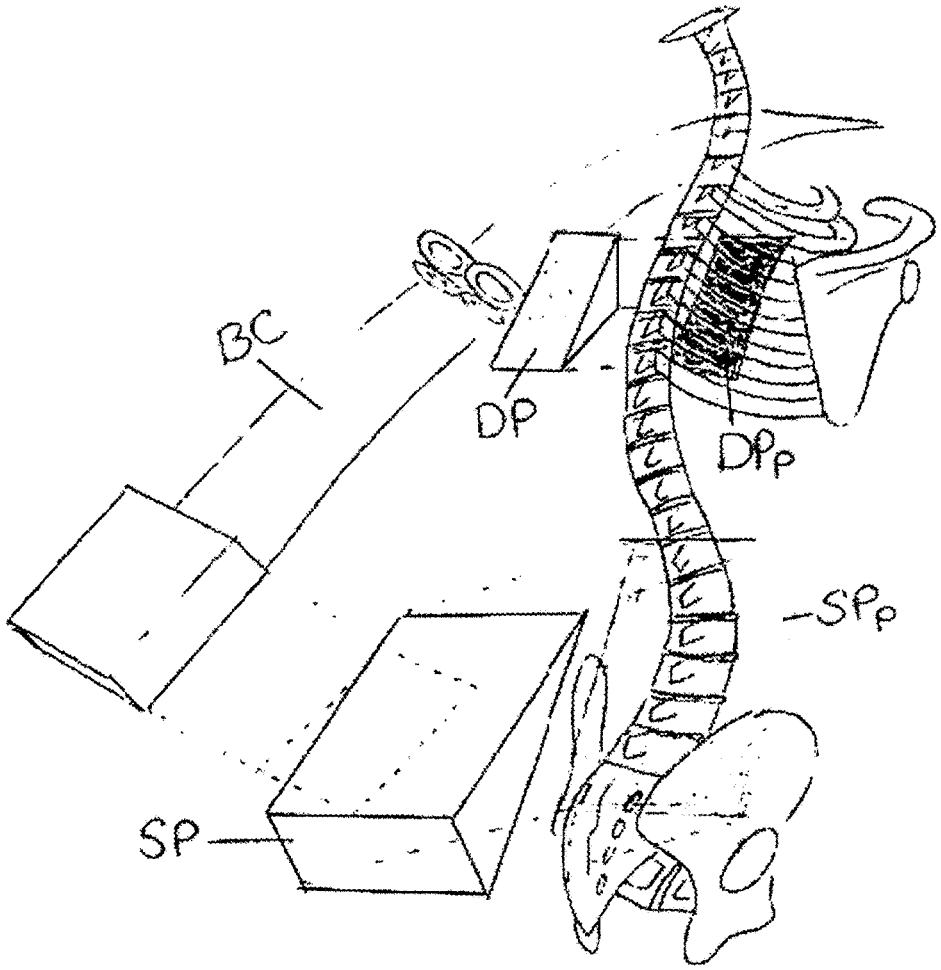
FIG. 15 illustrates an oblique right sided posterior view of an embodiment a sport backpack described herein.

The use of a wider shoulder strap, for example about 4 to about 5 inches broad in some embodiments, may allows for offloading trapezius muscles creating less point pressure on the trapezius and levator scapulae muscles. Such a strap may bridge the anatomical gap between the first rib and the acromion process of the scapula (outer edge of the shoulder bone) to carry the weight. The weight carried may be considerably offloaded due to the pad orientation. This may allow a wearer to have less shoulder discomfort and less fatigue. Furthermore, a single strap cinches around the trunk to diagonally offset the straight downward pull of gravity. By circumducting the torso as a diagonal lashing, the orientation of the strap allows the torso to function as a vertical post, (supported by the skeleton) instead of a flexing arm, (using trunk muscles and deep neck flexors) to carry the load. Once again, a wearer perceives a lighter feeling weight with less shoulder discomfort and less perceived fatigue that often accompanies prolonged discomfort from wearing a convention backpack. Such circumductive lashing along with the pad orientation and bat orientation may decrease the tendency towards forward head posture (FHP), which may decrease risk to the developing spines of young children and adolescents. Additionally, it may decrease muscle strain, decrease ligamentous sprain on developing spines in children and adolescents, which may offset a developmental problem. Sprain/strain on developing spines can create permanent damage, a phenomenon that has recently become a concern in the medical community due to the necessity of heavy school backpacks. Decreased stress on developing tissues and injury prevention may be benefits included in the various embodiments described herein. Less activity in the trapezius, levator scapulae, and sternocleidomastoid muscles may occur, thus allowing the deep neck flexors (longus coli and longus capitis) to more properly support and carry the cervical spine, which may increase a wearer's comfort and endurance on longer hikes; distances. Further, the stability of the skeletal structure (pelvis and ribcage) to carry a load instead of the aforementioned muscles may be attained, providing better carrying endurance. The diagonal strapping concept allows friction on the bone structure to accomplish more ergonomic weight distribution. Referring now to FIG. 15, which illustrates an oblique right sided posterior view of an embodiment a sport backpack described herein. FIG. 15 includes: a bat carrying cylinder holding unit (BC), sacral ramp pad (SP), dorsal pad (DP), sacral pad placement (SPp), and dorsal pad placement (DPp). Shaded areas on the anatomical element of the diagram represent pad location for a single strap design disclosed herein. Dotted lines represent an example of how elements of a bag may be assembled.

Figure 16:
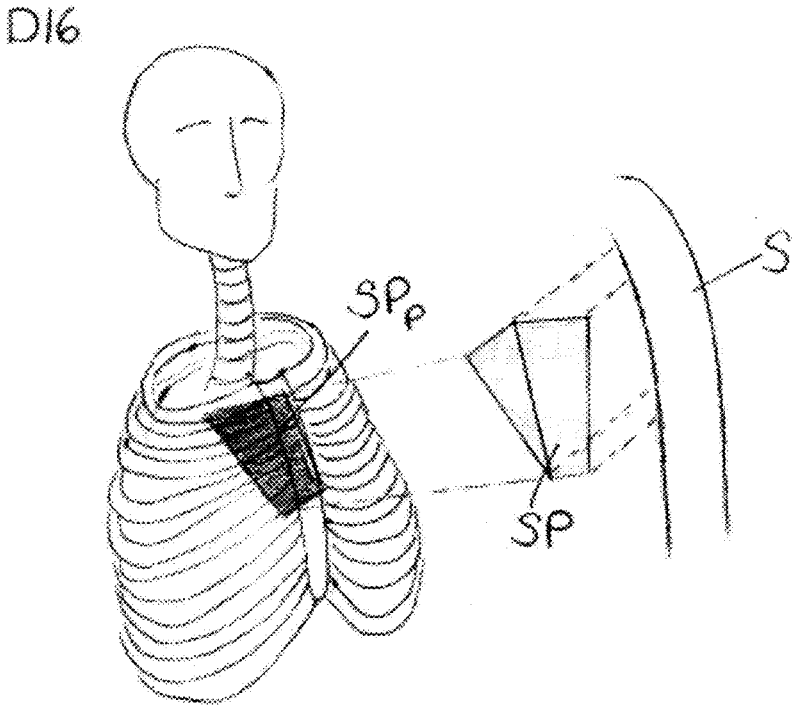
FIG. 16 illustrates a front perspective view of an embodiment of a single strap backpack disclosed herein.
Figure 17:
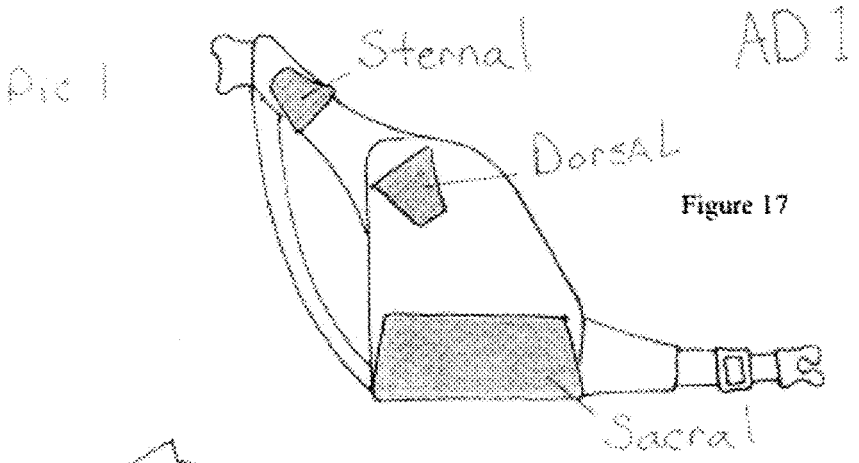
FIG. 17 illustrates a front view of an embodiment of a single sling backpack with clasps open.
Figure 18:
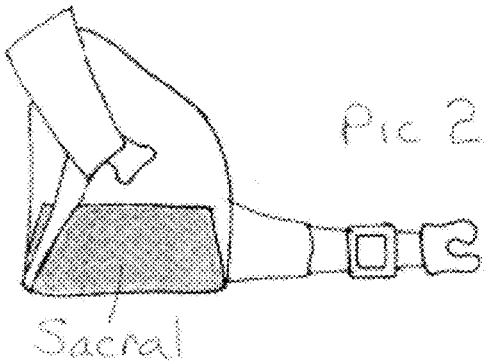
FIG. 18 illustrates the embodiment of FIG. 17 with the upper aspect of the single sling crossed over the front of the bag in the manner that it may be when worn.
Figure 19:
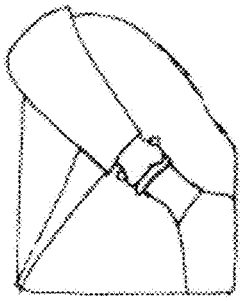
FIG. 19 illustrates a front view of the embodiment of FIG. 17 with the clasp fastened.

Certain benefits of an internal bat carrying cylinder may be recognized. For example, it may carry the load close to the center of spinal gravity, as the larger, heavier cylinders of the bats may be oriented close to the center of gravity of the carrier for better carrying and control. Additionally, bat carrying stability and postural control over bat movement may be increased as compared to traditional carriers. FIG. 16 illustrates an embodiment of a single strap sports backpack disclosed herein, including: (S) a strap; (SP) a sternal pad; and, (SPp) a placement location on the wearer's anatomy. FIG. 17 illustrates a front view of an embodiment of a single sling backpack with clasps open. This clasp may be any type of clasp known in the art. The position of pads described above, which are shaded grey, may be on an anterior part of a bag and are labeled "sacral," "dorsal," and "sternal." A lateral support sling may attach to an upper aspect of the single sling to the bottom of the bag on the shoulder side of the single sling. Figure illustrates the embodiment of FIG. 17 with the upper aspect of the single sling crossed over the front of the bag in the manner that it may be when worn. The "sacral" pad is also seen in this view. The lower aspect of the single sling remains in an open unclasped position. A buckle along the belt of the lower aspect is also illustrated, which may allow a user to adjust the length of the strap. FIG. 19 illustrates a front view of the embodiment of FIG. 17 with the clasp fastened.

The internal bat carrying cylinder may renders the bat mobility safer than other carrying mechanisms by avoiding accidental contact with other people and equipment and the wearer of the pack. With an internal bat carrying cylinder, the cylinders of the bats are in line with the single strap for ease of carrying, ease of putting the bag on and taking it off and/or loading and unloading the bag. The weight of the bats and/or other equipment/items loaded into the bag is in line with the weight bearing mechanism of the pack (diagonal lashing). The diagonal orientation of the bats shortens the functional carrying length of the bats for better manageability, and places bat weight in line with the diagonal lashing and pad offloading built into the design. Furthermore, bat orientation minimizes the tendency to adopt a forward head posture in order to carry the weight, as diagonal circumducting strap supports the bat weight using the concept of diagonal strapping to increase friction. A benefit to a wearer of an internal bat cylinder is the ability to place the COG of the actual bats in the optimal position in the pack and do so with stability. This may provide increased comfort, endurance, stability and safety.

FIG. 20 illustrates a right side view of an embodiment of a baseball backpack described above closed, with the pads described herein labeled "sacral," "dorsal," and "sternal." FIGS. 21 and 22 illustrate the backpack shown in FIG. 20 being worn. The handles of three baseball bats (a non-limiting exemplary use of the bag) are also illustrated. In other embodiments (not illustrated) a bat cylinder may be located diagonally in a direction opposing a single sling.

Figure 23:
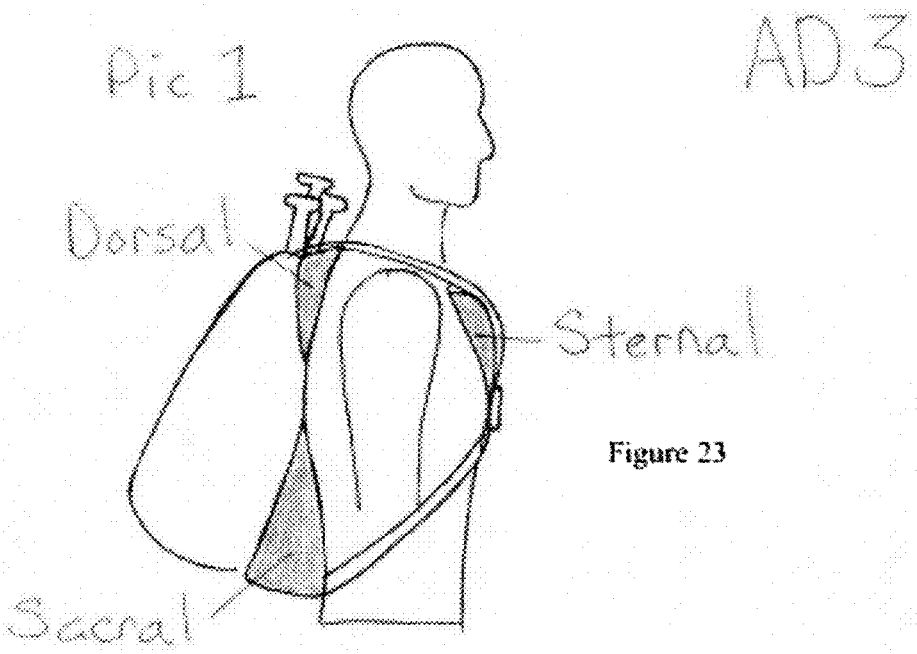
FIG. 23 illustrates a right side view of an embodiment of a bag described herein being worn by a user.
Figure 24:
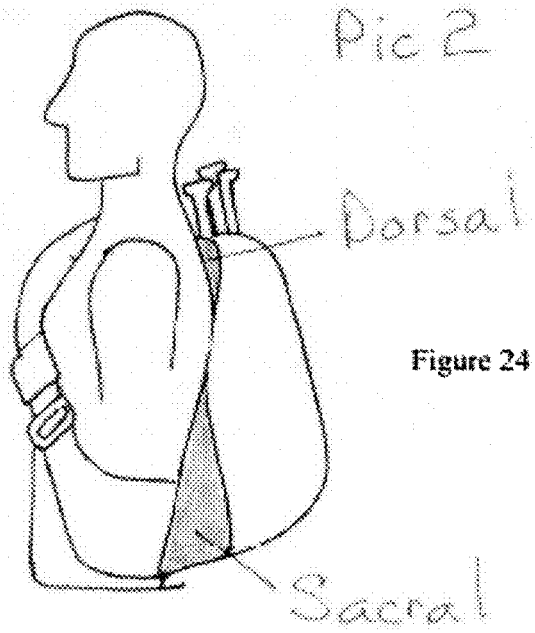
FIG. 24 illustrates a left side view of the embodiment of FIG. 23.

FIGS. 23 and 24 each illustrate side views of an embodiment of a bag being worn by a user. A shoulder strap is illustrated going over the shoulder and a support strap, on the right side, going up to a clasp. Triangularly oriented pads, as described herein, are also illustrated and labeled as the "sternal," "dorsal," and "sacral" pads. Bat handles are also illustrated, but the bag or backpack is not limited to being used as a baseball bag.

Several benefits of the triangular pad shape and orientation described herein may be recognized. For example, a lumbosacral ramp pad may lift the pack without any energy used by a wearer. This pad may alter the force vectors of a typical backpack to reduce downward pressure on the shoulder structure, giving a wearer less discomfort and more endurance. A triangular thoracic pad and sternal pad in the orientation of a triangle formed in the proportion of the golden ratio may serve to offload the trapezius and levator scapulae muscles, as well as the first rib. This feature may be referred to as cervicothoracic offloading, and may increase comfort and endurance. A lumbosacral ramp pad along with the triangular thoracic and sternal pads may shift the center of mass of the weight in the pack closer to the wearer's center of gravity (load shifting). A lumbosacral pad may be triangular with the base of the triangle resting on the sacrum and the thinner point of the triangle angled superiorly ending at the thoracolumbar junction. Alternatively, the lumbosacral pad may be any other shape illustrated in FIG. 28A-E or any other shape known in the art. Furthermore, in some embodiments, the pad may be constructed of foam, for example polyurethane foam, neoprene, or any other type of foam or rubber padding material known in the art or any combination thereof. In other embodiments, the padding may be constructed at least partially of an air bladder. In other embodiments, the density of the foam, neoprene, rubber, or other padding material known in the art may vary. Such an orientation may fill the space of the lumbar lordosis acting as a gap filling support, protecting the lumbar spine as an immediate support and prevents carrying a backpack in a bent over fashion. A fulcrum pad may be placed on the sternum and anterior ribcage creates a pivot point in the front to counter the posterior rotation which naturally occurs with any backpack. This anterior pad may act like a sesamoid bone in the human body. A sesamoid bone is a small bone nodule that develops in a tendon where the tendon passes over an angular structure, and assists the muscle/tendon complex by providing a fulcrum for better mechanical advantage. This anterior pad may be set in the strap in the front to create a fulcrum. This may offer a mechanical advantage that works in tandem with the thoracolumbar ramp to give a carrier the sensation of carrying a much lighter load. Additionally, the weight of the pack may be carried primarily on bone not muscle. The bones used in various embodiments of a backpack described herein are Sacrum (Tailbone), upper dorsal ribcage (ribs 2, 3, 4, 5 in the back), and the sternum (breastbone). When the positions of the pads are visualized from the side, as the pack is worn, the triangular orientation (approaching a golden triangle) becomes evident. This combination of pads in a diagonal lashing offloads the shoulder structure, decreased cervical and lumbar strain and affords a wearer more comfort and endurance for heavier loads and/or longer hikes.

Offloading of the glenohumeral joint (ball and socket joint of the shoulder) may also be accomplished by the single strap design. Conventional two strap bag designs push the ball backwards in the sockets bilaterally. Various embodiments of the single strap pack described herein may alleviate pressure on shoulder joints by weight bearing on the bone aspects of the ribcage, which may reduce injury potential to the shoulder joints. Additionally, each triangular pad may be shaped in the orientation of a golden triangle, and all pads (sacral, dorsal, and sternal) may be oriented in a large golden triangle when visualized from the side of a person wearing the pack, which may maximize mechanical advantage for creating a lifting and shifting the weight in the backpack. Furthermore, the larger triangular orientation of the pads (as seen from the side) creates a counter rotational force to the gravitational torque typical to a regular backpack. This pad may be referred to as a sacral ramp or a load shifting ramp that may have the greatest effect of making all three of the aforementioned pads work well together.

Figure 25:
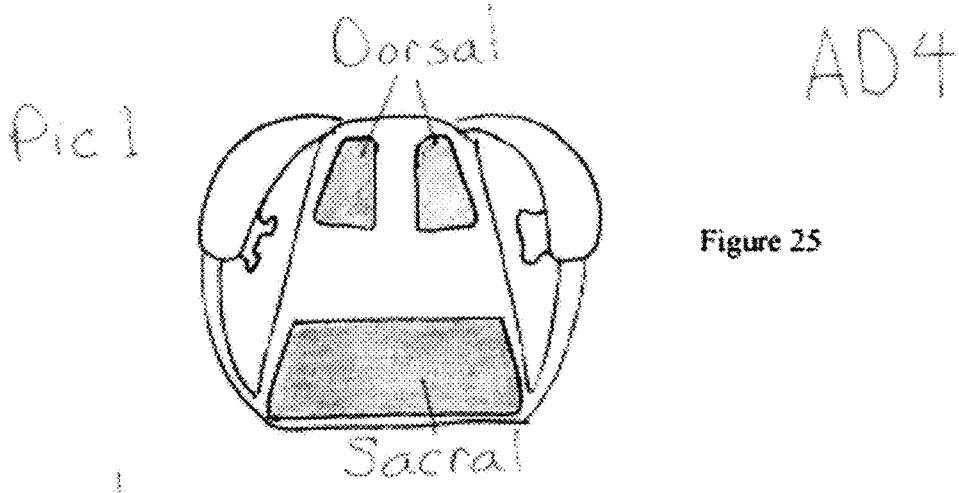
FIG. 25 illustrates a front view of an embodiment of a two strap backpack.
Figure 27:
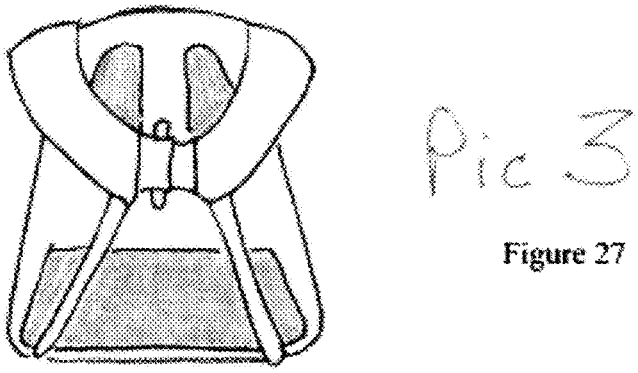
FIG. 27 illustrates a front view of the embodiment of FIG. 25 with shoulder straps closed.
Figure 28A:
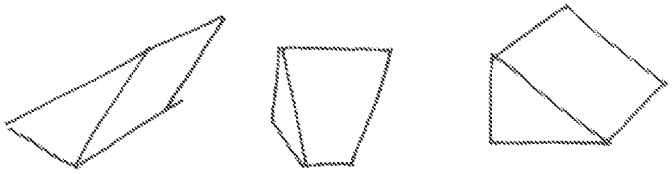
FIG. 28A-E illustrates various examples of embodiments of the shape of pads.
Figure 28B:
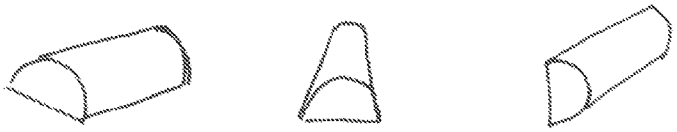
Figure 28C:
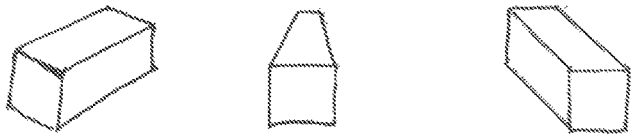
Figure 28D:
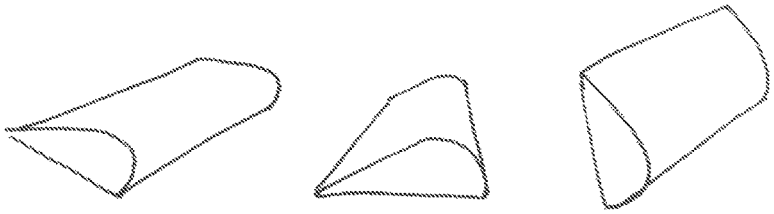
Figure 28E:
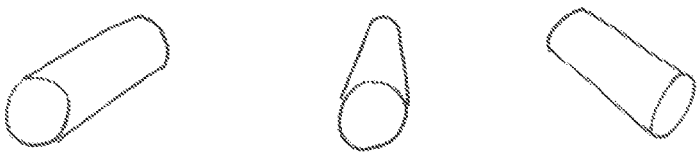

FIGS. 25-27 illustrate an embodiment of two strap backpack consistent with the padding described herein. FIG. 25 illustrates both shoulder straps in illustrated in a neutral "pre-closed" position, which allows visualization of two "dorsal" and a "sacral" pad. FIG. 26 illustrates a front view of the backpack with shoulder straps deflected away to the sides. Two possible positions for "sternal" pads are illustrated, and one or both may be used. As the sternal pads are moved closer to the collar bones more comfort may be provided to a wearer. Finally, FIG. 27 illustrates a front view of the backpack with shoulder straps closed.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A backpack for reducing forward head posture, wherein the backpack comprises:

one or more shoulder straps, wherein each of the one or more shoulder straps further comprises a sternal pad for contacting a wearer's sternum and upper anterior ribs when worn;

a wedge-shaped sacral pad comprising a first rectangular face, a second rectangular face, and a third rectangular face, wherein the first rectangular face further comprises an upper edge and a lower edge, the lower edge spanning a portion of a bottom of the backpack and the upper edge for contacting the wearer's thoracolumbar junction when worn, wherein the second rectangular face is connected to a back portion of the backpack;

one or more dorsal pads for contacting the wearer's spine and shoulder blade when worn; and wherein the sternal pad, wedge shaped sacral pad, and one of the one or more dorsal pads when worn by the wearer are arranged in a triangular configuration when viewed from a side perspective of the wearer, wherein the triangular configuration comprises an angle of about 72 degrees at an intersection of an invisible axis along a line extending from the triangularly-shaped sacral pad to the one or more dorsal pads and an invisible axis along a line extending from the sternal pad to the one or more dorsal pads, an angle of about 72 degrees at an intersection of an invisible axis along a line extending from the triangularly-shaped sacral pad to the sternal pad and an invisible axis along a line extending from the one or more dorsal pads to the sternal pad, and an angle of about 36 degrees at an intersection of an invisible axis along a line extending from the sternal pad to the triangularly-shaped sacral pad and an invisible axis along a line extending from the one or more dorsal pads to the triangularly-shaped sacral pad.

2. The backpack of claim 1, wherein the backpack includes two straps.

3. The backpack of claim 2, wherein the one or more dorsal pads includes two dorsal pads arranged in a bilateral configuration such that the two dorsal pads are in contact with a wearer's spine and shoulder blades when worn.

4. The backpack of claim 2, wherein the one or more dorsal pads includes a single dorsal pad, wherein the single dorsal pad includes a recessed groove at a location where the single dorsal pad is in contact with the wearer's spine when worn so as to minimize weight bearing on the spine.

5. The backpack of claim 1, wherein the backpack includes one strap.

6. The backpack of claim 1, wherein the one or more dorsal pads are smaller than the wedge shaped sacral pad.

7. The backpack of claim 1, wherein the sternal pad, wedge shaped sacral pad, and one of the one or more dorsal pads are constructed of foam, rubber padding, air bladders, or any combination thereof.

8. The backpack of claim 1, wherein the one or more shoulder straps are about 4 inches to about 5 inches wide.

9. The backpack of claim 5, wherein the backpack further includes an internal frame located at the same angle as the single strap, wherein the internal frame includes at least one cylinder-style opening proximate where the single strap passes over the wearer's shoulder when worn.

10. The backpack of claim 9, wherein the internal frame includes a plurality of receptacle cylinders proximate a bottom portion of the backpack.

11. The backpack of claim 1, wherein the lower edge of the wedge-shaped sacral pad spans an entirety of a bottom of the backpack.

12. The backpack of claim 1, wherein the one or more dorsal pads are triangularly shaped.

13. The backpack of claim 12, wherein the one or more triangularly shaped dorsal pads face inferiorly downward to a wearer's T6 vertebra when worn.

14. The backpack of claim 1, wherein the sternal pad acts as a fulcrum to offload a wear's shoulder and neck muscles when worn.

15. A backpack designed to reduce forward head posture, wherein the backpack comprises:

one or more shoulder straps, wherein each of the one or more shoulder straps further comprises a sternal pad for contacting a wearer's sternum and upper anterior ribs when worn;

a wedge-shaped sacral pad comprising a first rectangular face, a second rectangular face, and a third rectangular face, wherein the first rectangular face further comprises an upper edge and a lower edge, the lower edge spanning a bottom of the backpack and the upper edge for contacting the wearer's thoracolumbar junction when worn, wherein the second rectangular face is connected to a back portion of the backpack;

one or more dorsal pads for contacting the wearer's spine and shoulder blade when worn; and wherein the sternal pad, wedge shaped sacral pad, and one of the one or more dorsal pads when worn by the wearer are arranged in a triangular configuration when viewed from a side perspective of a wearer, wherein the triangular configuration is an isosceles triangle, with a longer first side and a second and a third side that are equal in length.

16. The backpack of claim 15, wherein the longer first side of the triangular configuration is 1.618 times longer than the second and the third sides of the triangular configuration.

17. The backpack of claim 15, wherein the one or more dorsal pads includes two dorsal pads arranged in a bilateral configuration such that the two dorsal pads are in contact with a wearer's spine and shoulder blades when worn.

18. The backpack of claim 17, wherein the one or more dorsal pads includes a single dorsal pad, wherein the single dorsal pad includes a recessed groove at a location where the single dorsal pad is in contact with the wearer's spine when worn so as to minimize weight bearing on the spine.

19. The backpack of claim 17, wherein the one or more shoulder straps are about 4 inches to about 5 inches wide.

* * * * *